US011135707B2

(12) United States Patent
Hersh

(10) Patent No.: US 11,135,707 B2
(45) Date of Patent: Oct. 5, 2021

(54) WRENCH ASSEMBLY

(71) Applicant: Hersh Designs LLC, Masonville, CO (US)

(72) Inventor: Jason William Hersh, Masonville, CO (US)

(73) Assignee: Hersh Designs LLC, Masonville, CO (US)

( * ) Notice: Subject to any disclaimer, the term of this patent is extended or adjusted under 35 U.S.C. 154(b) by 294 days.

(21) Appl. No.: 16/393,786

(22) Filed: Apr. 24, 2019

(65) Prior Publication Data

US 2019/0329386 A1 Oct. 31, 2019

Related U.S. Application Data

(60) Provisional application No. 62/663,002, filed on Apr. 26, 2018.

(51) Int. Cl.

| | |
|---|---|
| ***B25B 23/00*** | (2006.01) |
| ***B25G 1/06*** | (2006.01) |
| ***B25G 1/04*** | (2006.01) |
| ***B25B 13/04*** | (2006.01) |
| ***B25B 13/08*** | (2006.01) |

(52) U.S. Cl.

CPC ..... *B25B 23/0028* (2013.01); *B25G 1/063* (2013.01); *B25B 13/04* (2013.01); *B25B 13/08* (2013.01); *B25G 1/043* (2013.01)

(58) Field of Classification Search

CPC ..... B25B 23/0028; B25B 13/04; B25B 13/08
USPC ..... 81/177.2, 177.8, 177.9, 125.1, 124.5
See application file for complete search history.

(56) References Cited

U.S. PATENT DOCUMENTS

| | | | | |
|---|---|---|---|---|
| 107,539 | A * | 9/1870 | Rand | B25G 1/063 81/177.9 |
| 987,880 | A | 3/1911 | Horstman | |
| 1,191,967 | A | 10/1911 | Henriksen | |
| 1,109,032 | A | 9/1914 | Bersted | |
| 1,182,652 | A * | 5/1916 | Davis | B25G 1/063 81/177.9 |
| 1,316,044 | A * | 9/1919 | King | B25B 13/481 81/177.8 |
| 1,384,887 | A * | 7/1921 | Burndahl | B25G 1/063 81/177.8 |
| 1,615,169 | A * | 1/1927 | Ellis | B25B 13/481 81/177.8 |
| 3,004,455 | A | 10/1961 | Bashore et al. | |
| 3,270,597 | A | 9/1966 | Neff et al. | |
| 6,016,726 | A | 1/2000 | Wright | |
| 6,131,490 | A | 10/2000 | Lee | |

(Continued)

OTHER PUBLICATIONS

PCT International Patent Application No. PCT/US19/35182; International Search Report and Written Opinion of the International Searching Authority dated Aug. 8, 2019, 17 pages.

*Primary Examiner* — Hadi Shakeri
(74) *Attorney, Agent, or Firm* — Craig R. Miles; CR Miles P.C.

(57) ABSTRACT

A wrench assembly, and methods of making and using such a wrench assembly, whereby the wrench assembly includes a head, an opening disposed within the head, a first pivotal member coupled to the head, a plurality of radial slots inwardly extending into the first pivotal member, and a handle, whereby the head pivotally couples to the handle.

12 Claims, 11 Drawing Sheets

(56) References Cited

U.S. PATENT DOCUMENTS

| | | | | |
|---|---|---|---|---|
| 6,557,442 | B1 * | 5/2003 | Owoc | B25G 1/007 81/177.8 |
| 8,464,616 | B2 * | 6/2013 | Chang | B25G 1/063 81/177.9 |
| 9,221,157 | B1 | 12/2015 | Chen | |
| 2005/0102781 | A1 | 5/2005 | Tsuchiya et al. | |
| 2011/0185861 | A1 | 8/2011 | Hu | |

* cited by examiner

WRENCH ASSEMBLY

This United States Non-Provisional patent application claims the benefit of U.S. Provisional Patent Application No. 62/663,002, filed Apr. 26, 2018, hereby incorporated by reference herein.

I. SUMMARY OF THE INVENTION

A broad object of a particular embodiment of the invention can be to provide a wrench assembly, and methods of making and using such a wrench assembly, whereby the wrench assembly includes a head, an opening disposed within the head, a first pivotal member coupled to the head, a plurality of radial slots inwardly extending into the first pivotal member, and a handle, whereby the head pivotally couples to the handle.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1A:
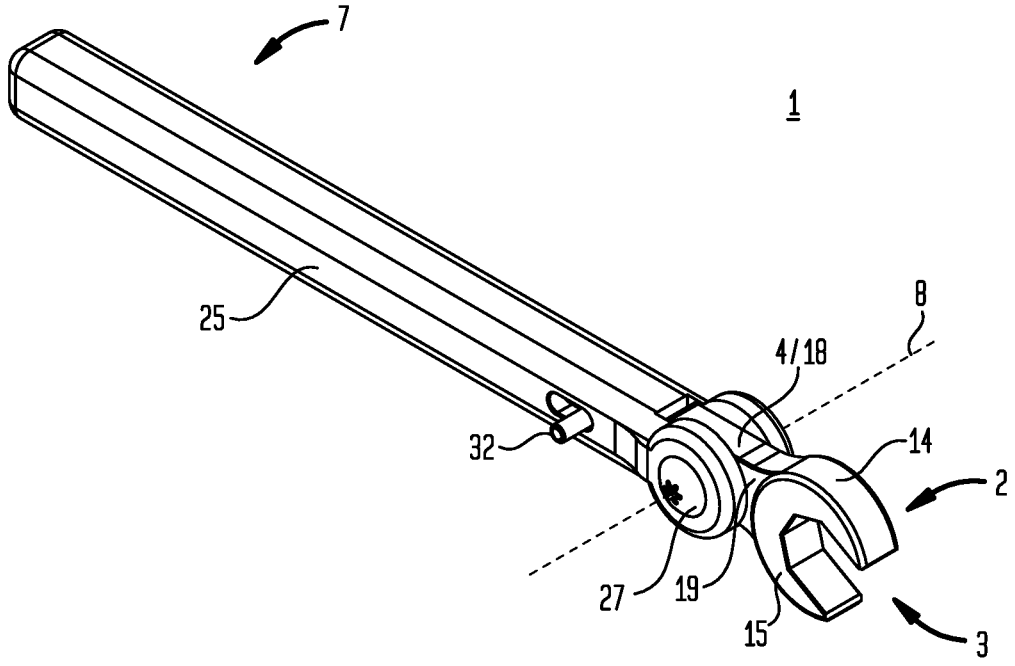
FIG. 1A shows a perspective view of a particular embodiment of a wrench assembly, whereby a head of the wrench assembly can be pivotally adjustable in relation to a handle of the wrench assembly.
Figure 1B:
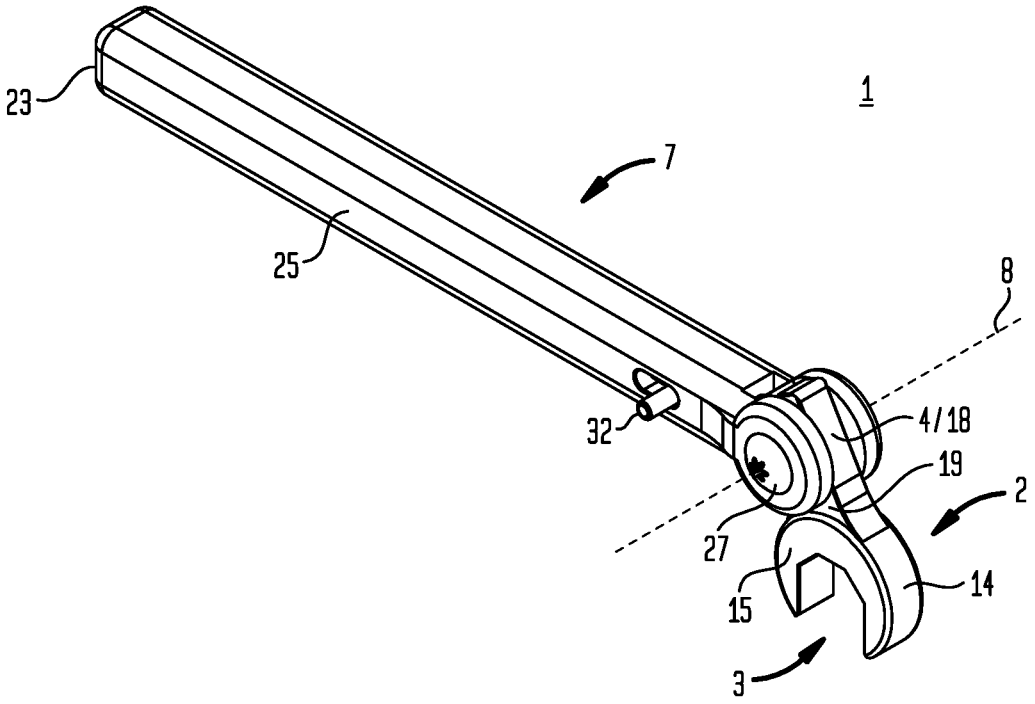
FIG. 1B shows a perspective view of the particular embodiment of the wrench assembly shown in FIG. 1A, but whereby the head is shown adjusted to a different position relative to the handle than the position shown in FIG. 1A.
Figure 2C:
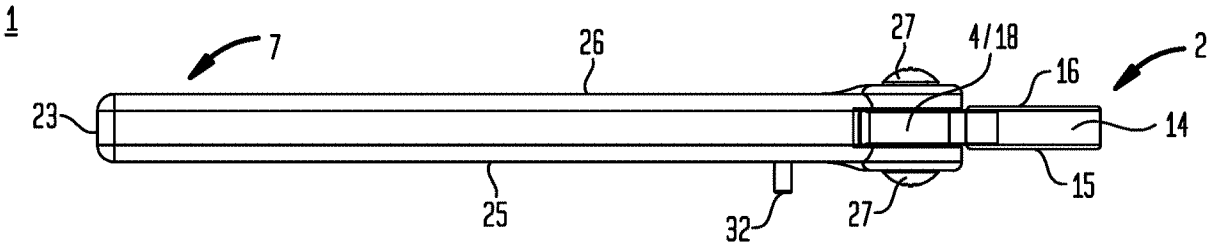
FIG. 2C shows a first side view of the particular embodiment of the wrench assembly shown in FIG. 2A.
Figure 2A:
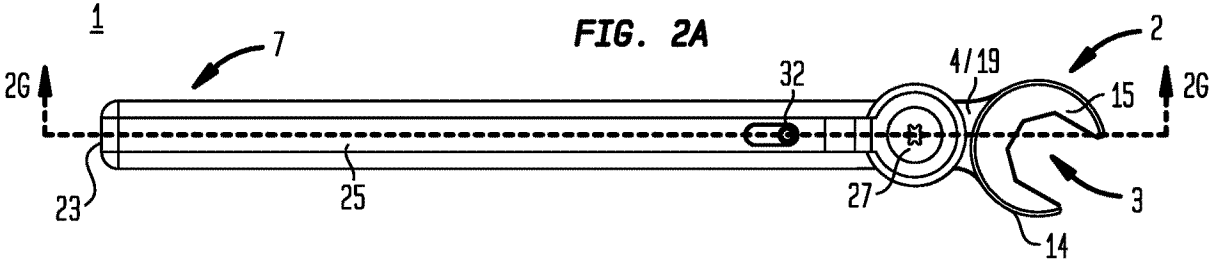
FIG. 2A shows a front view of a particular embodiment of a wrench assembly.
Figure 2D:
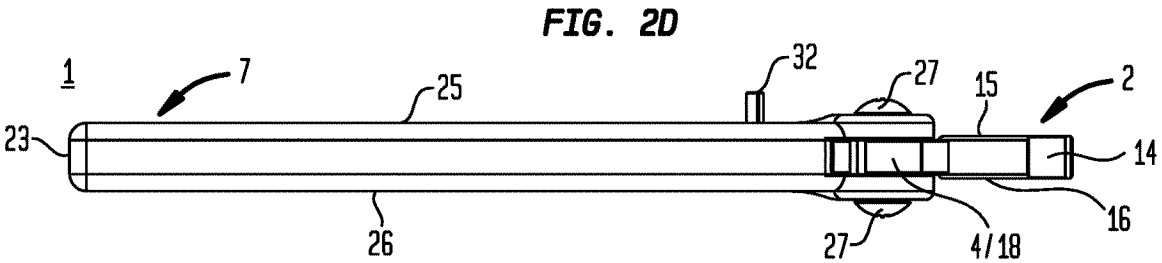
FIG. 2D shows a second side view of the particular embodiment of the wrench assembly shown in FIG. 2A.
Figure 2B:
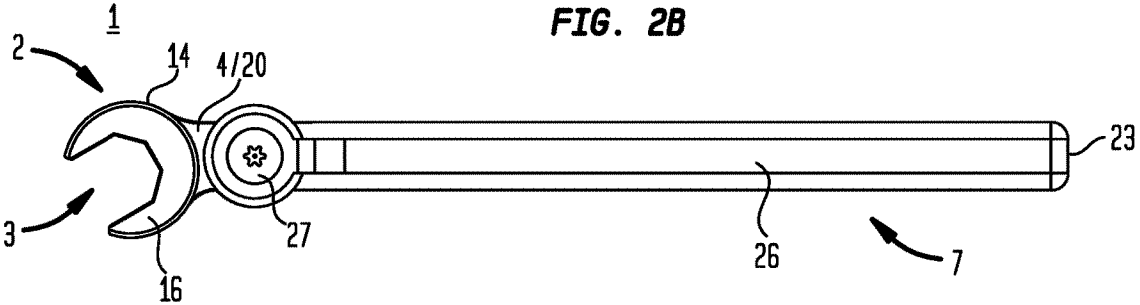
FIG. 2B shows a rear view of the particular embodiment of the wrench assembly shown in FIG. 2A.
Figure 2E:
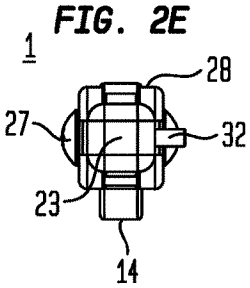
FIG. 2E shows a first end view of the particular embodiment of the wrench assembly shown in FIG. 2A.
Figure 2F:
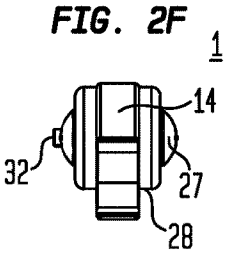
FIG. 2F shows a second end view of the particular embodiment of the wrench assembly shown in FIG. 2A.
Figure 2G:
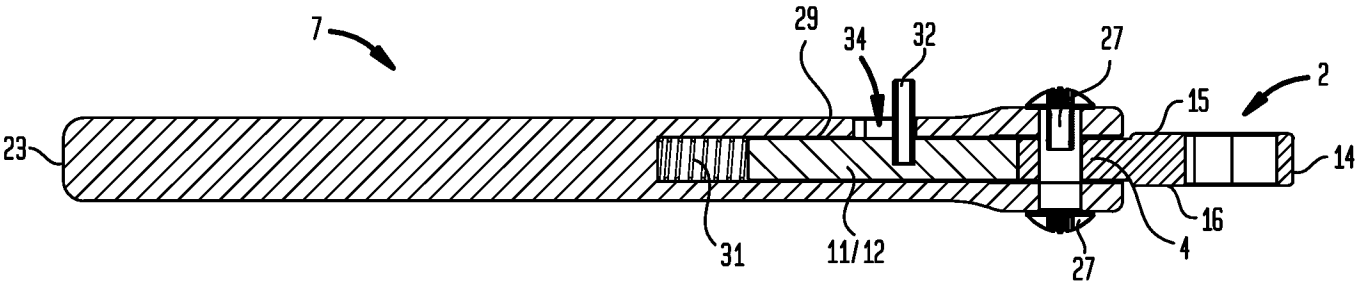
FIG. 2G shows a cross sectional view 2G-2G of the particular embodiment of the wrench assembly shown in FIG. 2A.
Figure 2H:
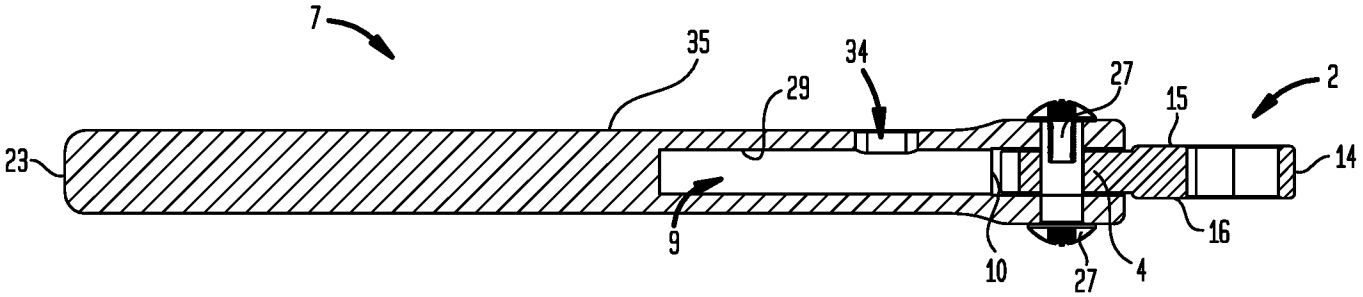
FIG. 2H shows a cross sectional view of the particular embodiment of the wrench assembly shown in FIG. 2A, but whereby the first axial cavity disposed in the handle is shown devoid of a first lock, a first biasing element, and a first actuator.

A wrench assembly (1) generally includes a head (2), an opening (3) disposed within the head (2), a first pivotal member (4) coupled to the head (2), a first pivotal member bore (5) disposed in the first pivotal member (4), a plurality of radial slots (6) inwardly extending into the first pivotal member (4), and a handle (7), whereby the first pivotal member (4) pivotally couples to the handle (7) to pivot about a first pivot axis (8) passing through the first pivotal member bore (5).

Additionally, the wrench assembly (1) can include a first axial cavity (9) disposed within the handle (7) to communicate with a handle open first end (10), and a first lock (11) slidably disposed within the first axial cavity (9). The first lock (11) can be slidable between first and second positions (12)(13), whereby in the first position (12), the first lock (11) engages with one of the radial slots (6) disposed in the first pivotal member (4) to preclude movement of the head (2) about the first pivot axis (8). Conversely, in the second position (13), the first lock (11) can be disengaged from the first pivotal member (4), thus allowing movement of the head (2) about the first pivot axis (8) to adjust the position of the head (2) in relation to the handle (7).

Now referring primarily to FIG. 1A through FIG. 8B, the wrench assembly (1) includes a head (2) having a head side surface (14) disposed between opposing head first and second faces (15)(16). As to particular embodiments, the head first and second faces (15)(16) may be substantially planar.

Figure 3:
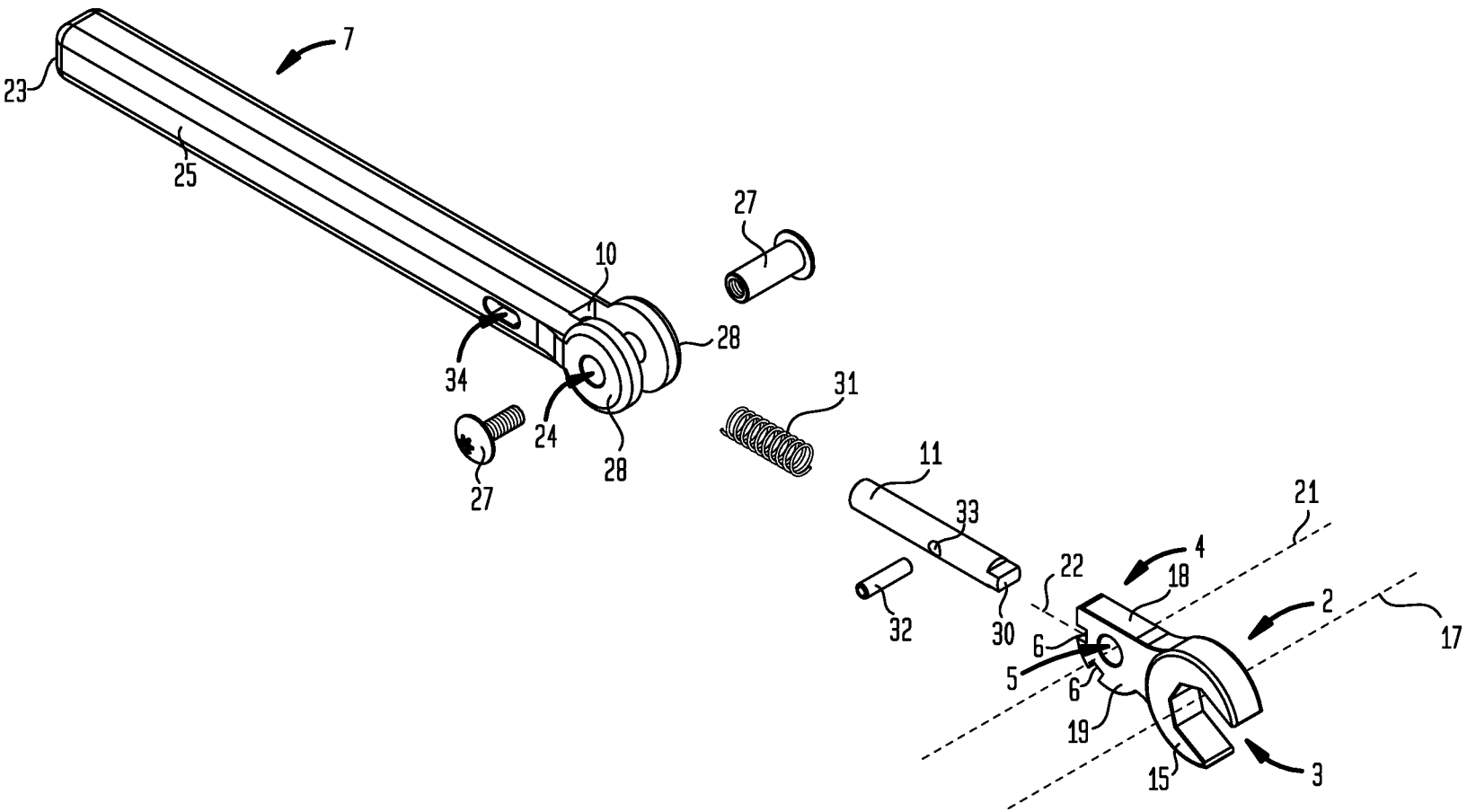
FIG. 3 shows an exploded perspective view of a particular embodiment of a wrench assembly.

Additionally, the head (2) includes an opening (3) communicating between the head first and second faces (15)(16), whereby the opening (3) can be configured to receive a rotary fastener. Upon receipt of the rotary fastener within the opening (3), the head (2) can rotate about a rotation axis (17) which passes through the opening (3) in substantially orthogonal relation to the head first and second faces (15)(16) (as shown in the Example of FIG. 3) to correspondingly rotate the rotary fastener.

Now referring primarily to FIG. 5A through FIG. 8B, as to particular embodiments, the opening (3) can be laterally enclosed; following the head (2) can be configured as an annular member. As to these particular embodiments, the head (2) can be configured to provide a box-end wrench or a socket wrench, whereby the laterally-enclosed opening (3) can be configured to grip the face(s) of a rotary fastener, such as a bolt or nut.

Now referring primarily to FIG. 1A through FIG. 4D, as to other particular embodiments, the opening (3) can communicate with the opposing head first and second faces (15)(16) as well as the head side surface (14), meaning that the opening (3) can be generally U-shaped. As to these particular embodiments, the head (2) can be configured as an open-end wrench, which may include one or more jaws configured to grip the face(s) of a rotary fastener, such as a bolt or nut. As to particular embodiments, the jaw may be adjustable to provide a lesser or greater opening (3) (not shown), depending upon the application.

Now referring primarily to FIG. 1A through FIG. 8B, the wrench assembly (1) can further include a first pivotal member (4) coupled to, directly coupled to, connected to, directly connected to, or integrated with the head (2), whereby the first pivotal member (4) can include a first pivotal member side surface (18) disposed between opposing first pivotal member first and second faces (19)(20). As to particular embodiments, the first pivotal member first and second faces (19)(20) may be substantially planar. As to particular embodiments, the first pivotal member first and second faces (19)(20) can be substantially parallel to the head first and second faces (15)(16). As to particular embodiments, the first pivotal member first and second faces (19)(20) can be substantially coplanar with the head first and second faces (15)(16).

Now referring primarily to FIG. 3, FIG. 7, FIG. 8A, and FIG. 8B, a first pivotal member bore (5) can be disposed in the first pivotal member (4) to communicate between the first pivotal member first and second faces (19)(20).

Figure 7:
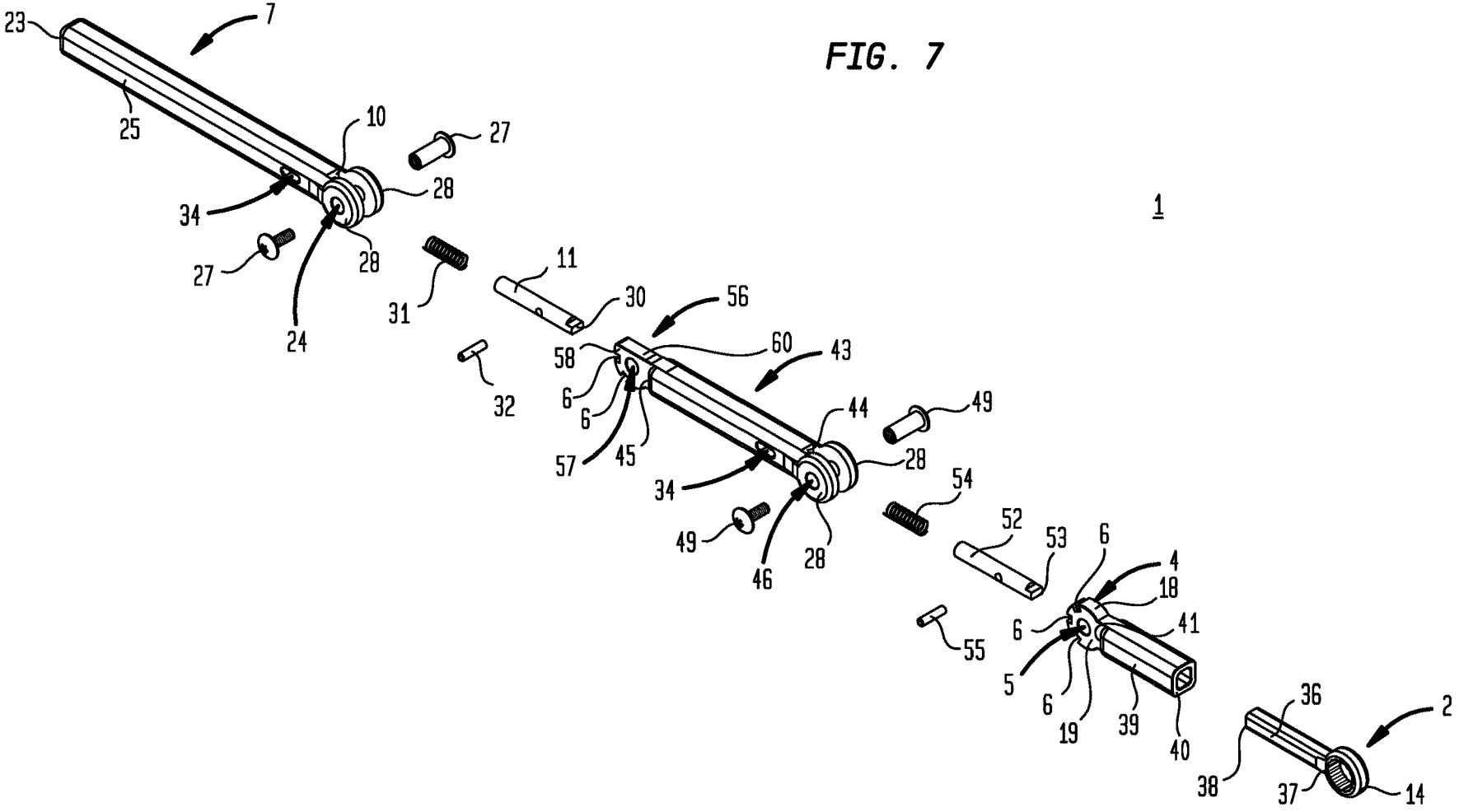
FIG. 7 shows an exploded perspective view of a particular embodiment of a wrench assembly.
Figure 8A:
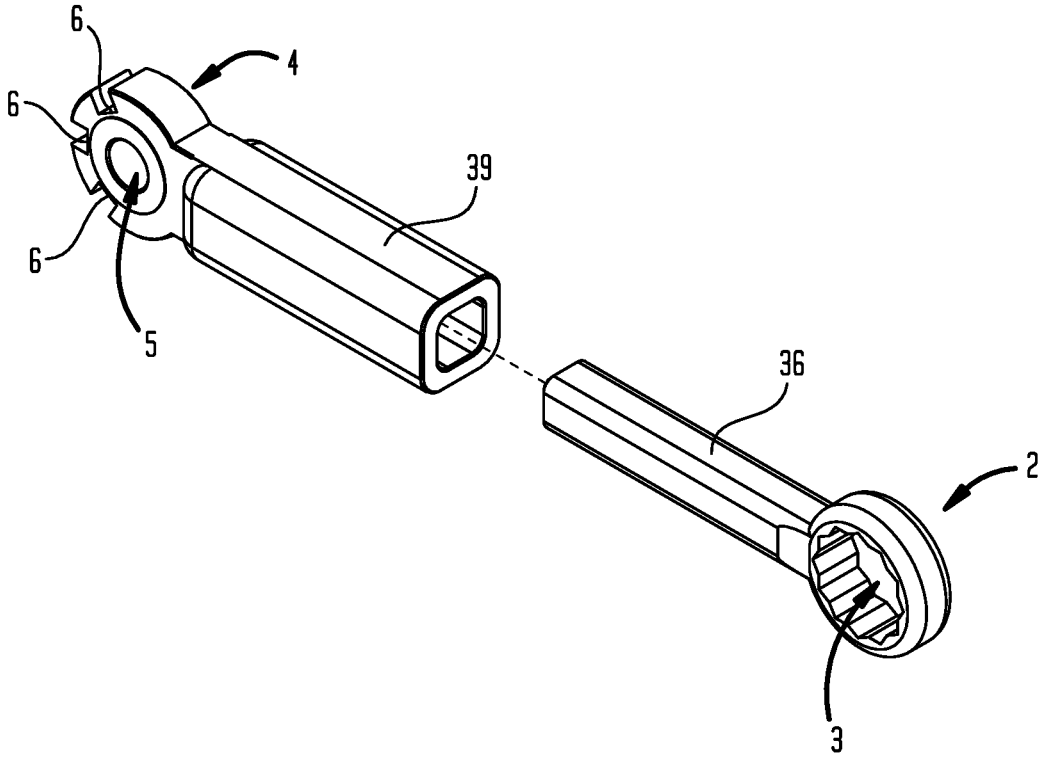
FIG. 8A shows an exploded perspective view of a particular embodiment of a head and a first pivotal member of a wrench assembly, whereby the head couples to the first pivotal member to provide a first configuration.

Now referring primarily to FIG. 3, FIG. 7, and FIG. 8A, as to particular embodiments, a first pivotal member bore pass-through axis (21) can be generally parallel to the rotation axis (17) which passes through the opening (3) disposed within the head (2).

Figure 8B:
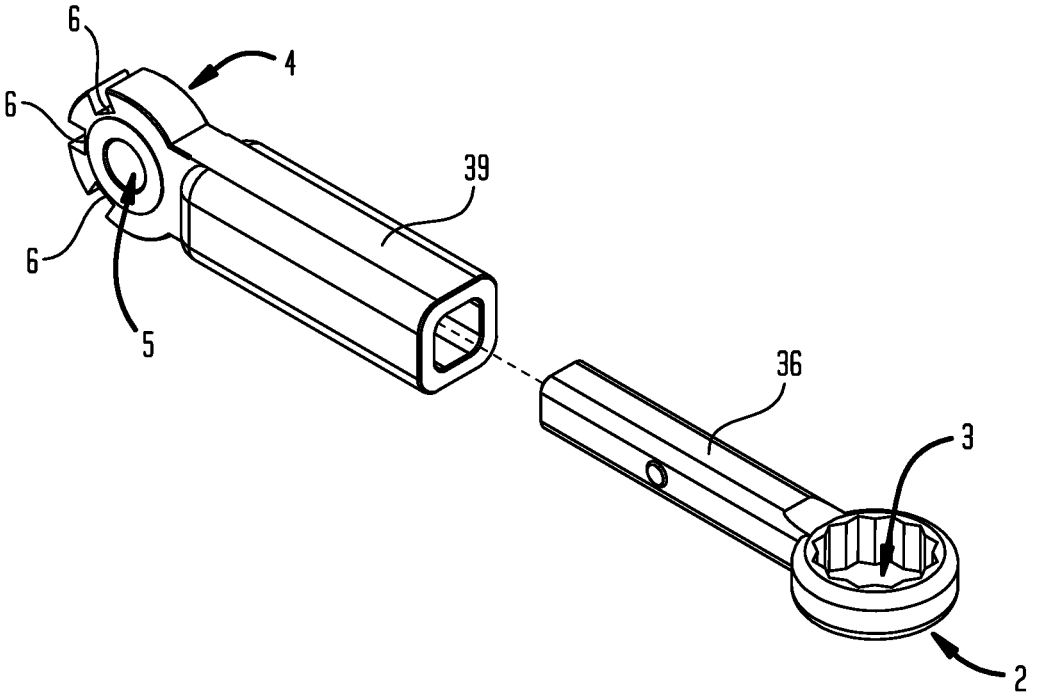
FIG. 8B shows an exploded perspective view of a particular embodiment of a head and a first pivotal member of a wrench assembly, whereby the head couples to the first pivotal member to provide a second configuration.

Now referring primarily to FIG. 8B, as to particular embodiments, the first pivotal member bore pass-through axis (21) can be generally perpendicular to the rotation axis (17) which passes through the opening (3) disposed in the head (2).

Now referring primarily to FIG. 8A and FIG. 8B, as to particular embodiments, the head (2) can be differentially coupled to the first pivotal member (4) such that in a first configuration (as shown in FIG. 8A), the head (2) can be coupled to the first pivotal member (4) such that the first pivotal member bore pass-through axis (21) can be generally parallel to the rotation axis (17) which passes through the opening (3) disposed in the head (2). Alternatively, in a second configuration (as shown in FIG. 8B), the head (2) can be coupled to the first pivotal member (4) such that the first pivotal member bore pass-through axis (21) can be generally perpendicular to the rotation axis (17) which passes through the opening (3) disposed in the head (2).

Now referring primarily to FIG. 3 and FIG. 7, a plurality of radial slots (6) can be disposed in the first pivotal member (4) in radially spaced-apart relation, whereby each of the slots (6) can inwardly extend from the first pivotal member side surface (18) toward a central portion of the first pivotal member (4). Correspondingly, the slots (6) can communicate with the first pivotal member side surface (18). Additionally, as to particular embodiments, the slots (6) can also communicate with the first pivotal member first and second faces (19)(20).

Now referring primarily to FIG. 3, as to particular embodiments, a slot pass-through axis (22) can be substantially orthogonal to the first pivotal member side surface (18) or substantially parallel to the first pivotal member first and second faces (19)(20). Also, as to particular embodiments, the slot pass-through axis (22) can be substantially orthogonal to the first pivotal member bore pass-through axis (21). Moreover, as each of the slots (6) can be radially disposed within the first pivotal member (4), the slot pass-through axis (22) of each of the slots (6) can be radial or positioned along a radius.

Now referring primarily to FIG. 1A through FIG. 7, the wrench assembly (1) can further include a handle (7) having a handle open first end (10) opposite a handle second end (23). The first pivotal member (4) can pivotally couple to the handle (7) such that the first pivotal member (4) and the head (2) coupled to the first pivotal member (4) can pivot in relation to the handle (7).

Now referring primarily to FIG. 3 and FIG. 7, the handle (7) can include a handle bore (24) disposed therein proximate the handle open first end (10), whereby the handle bore (24) can communicate between opposing handle first and second faces (25)(26). Following, a first pivot element (27) can pass through aligned handle and first pivotal member bores (24)(5) to pivotally couple the first pivotal member (4)

to the handle (7) for pivotal movement about the first pivot axis (8), whereby the first pivot element (27) can define the first pivot axis (8).

As to particular embodiments, the handle open first end (10) can overlappingly engage with the first pivotal member (4) to align the handle and first pivotal member bores (24)(5).

As to particular embodiments, the handle open first end (10) can telescopingly engage with the first pivotal member (4) to align the handle and first pivotal member bores (24)(5).

As to particular embodiments, the handle bore (24) can be disposed in a pair of axial protrusions (28) which dispose in spaced-apart relation proximate the handle open first end (10). As to particular embodiments, each axial protrusion (28) can be coupled to, directly coupled to, connected to, directly connected to, or integrated with one of the handle first and second faces (25)(26).

Now referring primarily to FIG. 2G, FIG. 2H, FIG. 6G, and FIG. 6H, the handle (7) can include a first axial cavity (9) disposed therein to communicate with the handle open first end (10), whereby the first axial cavity (9) can be laterally bound by a handle internal surface (29) of the handle (7).

Now referring primarily to FIG. 2G, FIG. 3, FIG. 4B, FIG. 4D, FIG. 6G, and FIG. 7, the wrench assembly (1) can further include a first lock (11) terminating in a first lock end (30) which can be configured for engagement with a radial slot (6). The first lock (11) can be (i) configured for slidable disposition or (ii) slidably disposed within the first axial cavity (9), whereby the first lock (11) can be slidable between first and second positions (12)(13). When in the first position (12), the first lock end (30) can dispose (i) outwardly from the first axial cavity (9) or (ii) toward the handle open first end (10), whereby in this position, the first lock end (30) can be relatively closer to the handle open first end (10) than when the first lock disposes in the second position (13). Accordingly, when in the second position (13), the first lock end (30) can dispose (i) inwardly, receding into the first axial cavity (9), or (ii) away from the handle open first end (10), whereby in this position, the first lock end (30) can be relatively farther from the handle open first end (10) than when the first lock (11) disposes in the first position (12).

Figure 4A:
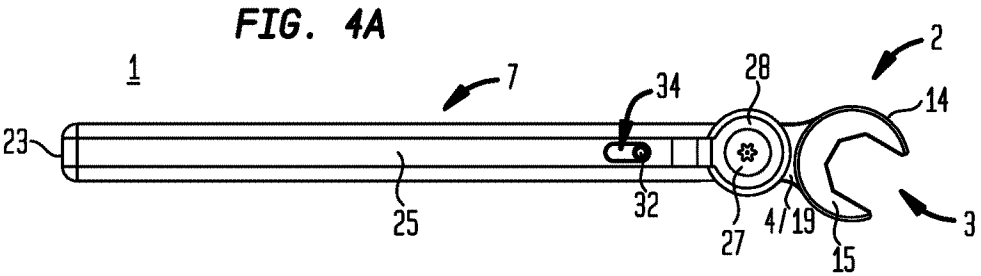
FIG. 4A shows a front view of a particular embodiment of a wrench assembly, whereby the first lock disposes in the first position to engage with a radial slot disposed in the first pivotal member, thus precluding movement of the head about the first pivot axis.
Figure 4B:
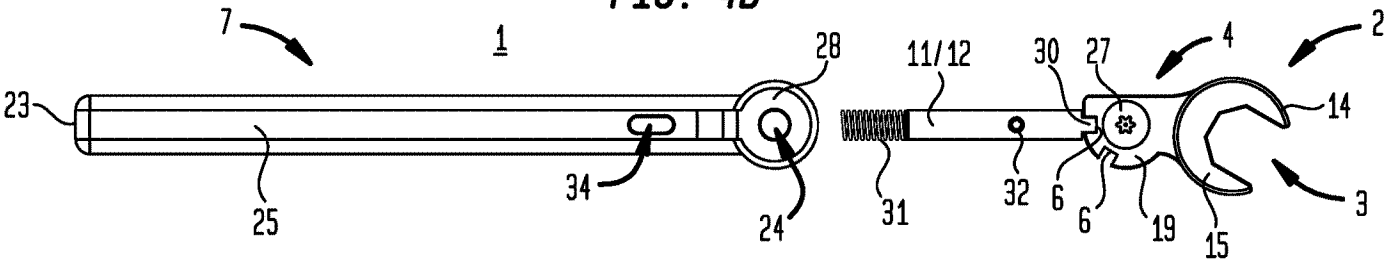
FIG. 4B shows a front view of the particular embodiment of the wrench assembly shown in FIG. 4A, but whereby the handle is exploded leftward from the other components of the wrench assembly to illustrate the disposition of the first lock in the first position relative to the first pivotal member.

Correspondingly, when the first pivotal member (4) and the handle (7) are pivotally coupled, the first lock (11) in the first position (12) disposes the first lock end (30) toward the handle open first end (10) for engagement with a radial slot (6) disposed in the first pivotal member (4) (as shown in the examples of FIG. 4A and FIG. 4B) to preclude movement of the first pivotal member (4) and the head (2) coupled to the first pivotal member (4) about the first pivot axis (8), which may fix the position of the head (2) in relation to the handle (7).

Figure 4C:
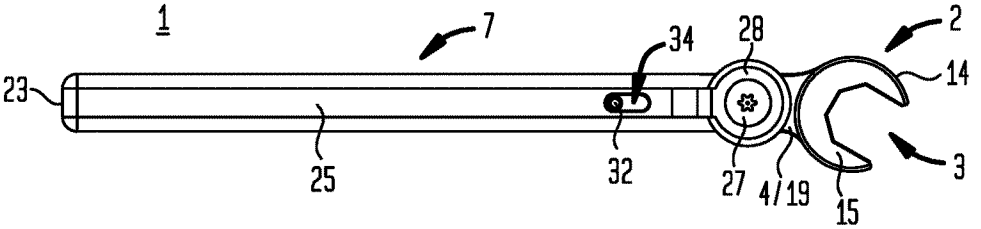
FIG. 4C shows a front view of a particular embodiment of a wrench assembly, whereby the first lock disposes in the second position, thus allowing movement of the head about the first pivot axis to adjust the position of the head in relation to the handle.
Figure 4D:
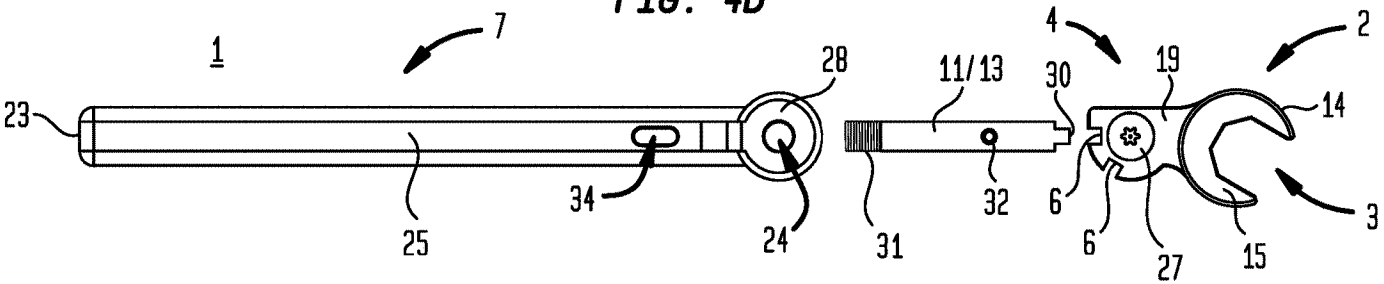
FIG. 4D shows a front view of the particular embodiment of the wrench assembly shown in FIG. 4C, but whereby the handle is exploded leftward from the other components of the wrench assembly to illustrate the disposition of the first lock in the second position relative to the first pivotal member.
Figure 5A:
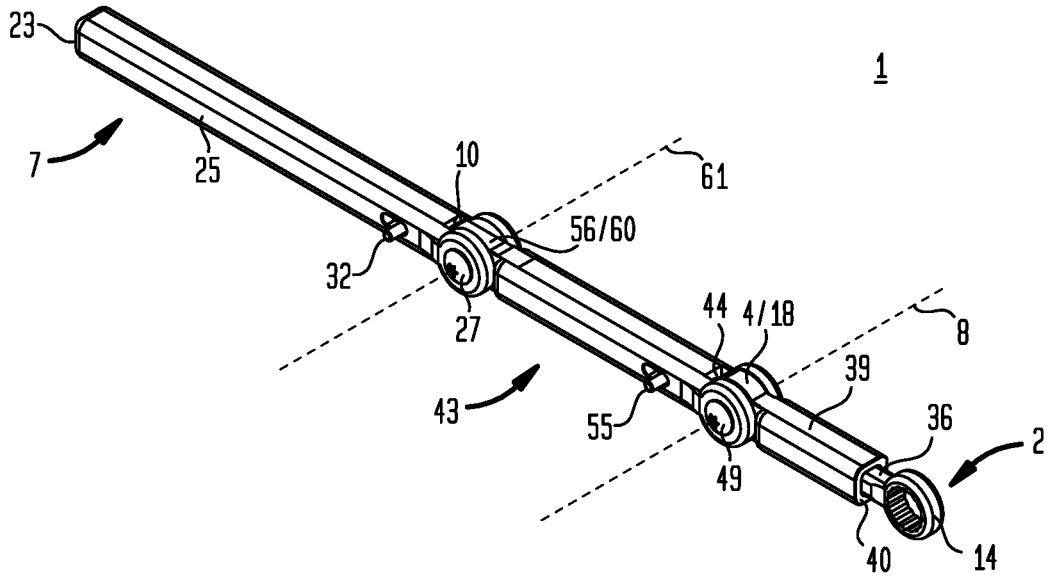
FIG. 5A shows a perspective view of a particular embodiment of a wrench assembly, whereby a head of the wrench assembly can be pivotally adjustable in relation to an elongate member, and the elongate member can be pivotally adjustable in relation to a handle.
Figure 5B:
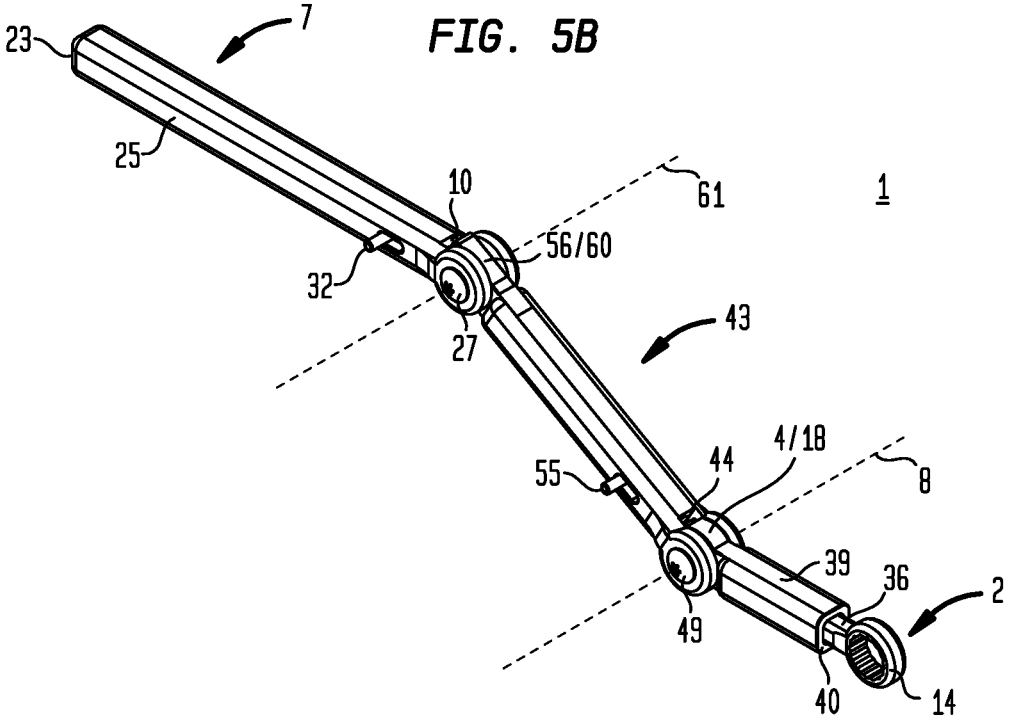
FIG. 5B shows a perspective view of the particular embodiment of the wrench assembly shown in FIG. 5A, but whereby the head is shown adjusted to a different position relative to the elongate member than the position shown in FIG. 5A, and the elongate member is shown adjusted to a different position relative to the handle than the position shown in FIG. 5A.

In contrast, when the first pivotal member (4) and the handle (7) are pivotally coupled, the first lock (11) in the second position (13) disposes the first lock end (30) away from handle open first end (10), thereby disengaging the first lock end (30) from the first pivotal member (4) and in particular, disengaging the first lock end (30) from a radial slot (6) disposed in the first pivotal member (4) (as shown in the examples of FIG. 4C and FIG. 4D), thus allowing movement of the first pivotal member (4) and the head (2) coupled to the first pivotal member (4) about the first pivot axis (8) to adjust the position of the head (2) in relation to the handle (7).

Now referring primarily to FIG. 2G, FIG. 3, FIG. 4B, FIG. 4D, FIG. 6G, and FIG. 7, as to particular embodiments, the first lock (11) can be biased toward the first position (12) by a first biasing element (31) which can function to bias the first lock end (30) toward the handle open first end (10). As but one illustrative example, the first biasing element (31) can be configured as a resiliently compressible element, such as a spring (for example, a coil spring), which can be disposed within the first axial cavity (9) toward the handle second end (23). Thus, the first lock (11) can be positioned within the first axial cavity (9) between the resiliently compressible element and the handle open first end (10). Following, when the resiliently compressible member disposes in a non-compressed condition, which can be the normal condition, the resiliently compressible member biases the first lock (11) toward the first position (12) (as shown in the examples of FIG. 4B).

Conversely, upon forcible urging, the resiliently compressible member can be compressed toward a compressed condition, allowing the first lock (11) to move inwardly within the first axial cavity (9) toward the handle second end (23) to disengage the first lock end (30) from the first pivotal member (4) and in particular, disengage the first lock end (30) from a radial slot (6) disposed in the first pivotal member (4), thus disposing the first lock (11) in the second position (13) (as shown in the examples of FIG. 4D).

Now referring primarily to FIG. 1A through FIG. 7, as to particular embodiments, the wrench assembly (1) can further include a first actuator (32) coupled to the first lock (11), whereby the first actuator (32) can facilitate sliding of the first lock (11) within the first axial cavity (9), for example between the first position (12) and the second position (13). As to particular embodiments, the first actuator (32) can outwardly extend from the first lock (11). As to particular embodiments, the first actuator (32) can radially outwardly extend from the first lock (11).

Now referring primarily to FIG. 3 and FIG. 7, as to particular embodiments, the first actuator (32) can be coupled to the first lock (11) via a recess (33) disposed within the first lock (11), whereby the recess (33) can be configured to receive a portion of the first actuator (32) to couple the first actuator (32) to the first lock (11). As to particular embodiments, the recess (33) can inwardly extend into the first lock (11) from the first lock external surface. As to particular embodiments, the recess (33) can be a radial recess (33).

Now referring primarily to FIG. 2G, FIG. 2H, FIG. 3, FIG. 6G, FIG. 6H, and FIG. 7, as to particular embodiments, the first actuator (32) can pass through a longitudinal channel (34) disposed within the handle (7) to communicate between handle internal and external surface (29)(35) and in particular, to communicate between the first axial cavity (9) and the handle external surface (35). Thus, the first actuator (32) coupled to the first lock (11) disposed within the first axial cavity (9) can be positioned proximate the handle external surface (35) to easily facilitate sliding of the first lock (11) within the first axial cavity (9).

Now referring primarily to FIG. 1A through FIG. 4D, as to particular embodiments, the head (2) and the first pivotal member (4) can be integrated, meaning that the components (i) can be united to provide a one-piece construct, a monolithic construct, or a unified whole, or (ii) can be formed as a one-piece construct, a monolithic construct, or a unified whole. Said another way, the head (2) and the first pivotal member (4) can be integrally formed, meaning connected together so as to make up a single complete piece or unit, or so as to work together as a single complete piece or unit, and so as to be incapable of being easily dismantled without destroying the integrity of the piece or unit.

Now referring primarily to FIG. 5A through FIG. 8B, as to other particular embodiments, the head (2) and the first pivotal member (4) can be discrete components, which can be coupled together. As but one illustrative example, the head (2) can be coupled to, directly coupled to, connected to, directly connected to, or integrated with a body (36). For example, the body (36) can be configured as an elongate body (36) having elongate body first and second ends (37)(38), whereby the head (2) can be axially coupled to the elongate body first end (37).

Additionally, the first pivotal member (4) can be coupled to, directly coupled to, connected to, directly connected to, or integrated with a sleeve (39). For example, the sleeve (39) can be configured as an elongate sleeve (39) having an elongate sleeve open first end (40) opposite an elongate sleeve second end (41), whereby the first pivotal member (4) can be axially coupled to the elongate sleeve second end (41).

Further, the elongate sleeve (39) can bound a second axial cavity (42) which communicates with the elongate sleeve open first end (40), whereby the elongate body (36) can be received (for example, telescopingly received) within the second axial cavity (42) to couple the elongate body (36) to the elongate sleeve (39) and correspondingly, to couple the head (2) to the first pivotal member (4). Additionally, the first pivotal member (4) can be pivotally coupled to the handle (7) to provide an embodiment of the wrench assembly (1).

Now referring primarily to FIG. 5A through FIG. 7, as to particular embodiments, the head (2) can be spaced apart from the handle (7) by the incorporation of one or more elongate members (43) between the head (2) and the handle (7). As to particular embodiments, an elongate member (43) can include an elongate member open first end (44) opposite an elongate member second end (45). The first pivotal member (4) can pivotally couple to the elongate member (43) such that the first pivotal member (4) and the head (2) coupled to the first pivotal member (4) can pivot in relation to the elongate member (43), whereby the elongate member (43) can couple to the handle (7), thus pivotally coupling the head (2) to the handle (7).

Now referring primarily to FIG. 7, the elongate member (43) can include an elongate member bore (46) disposed therein proximate the elongate member open first end (44), whereby the elongate member bore (46) can communicate between opposing elongate member first and second faces (47)(48). Following, a second pivot element (49) can pass through aligned elongate member and first pivotal member bores (46)(5) to pivotally couple the first pivotal member (4) to the elongate member (43) for pivotal movement about the first pivot axis (8), whereby the second pivot element (49) can define the first pivot axis (8).

As to particular embodiments, the elongate member open first end (44) can overlappingly engage with the first pivotal member (4) to align the elongate member and first pivotal member bores (46)(5).

As to particular embodiments, the elongate member open first end (44) can telescopingly engage with the first pivotal member (4) to align the elongate member and first pivotal member bores (46)(5).

As to particular embodiments, the elongate member bore (46) can be disposed in a pair of axial protrusions (28) which dispose in spaced-apart relation proximate the elongate member open first end (44). As to particular embodiments, each axial protrusion (28) can be coupled to, directly coupled to, connected to, directly connected to, or integrated with one of the elongate member first and second faces (47)(48).

Figure 6C:
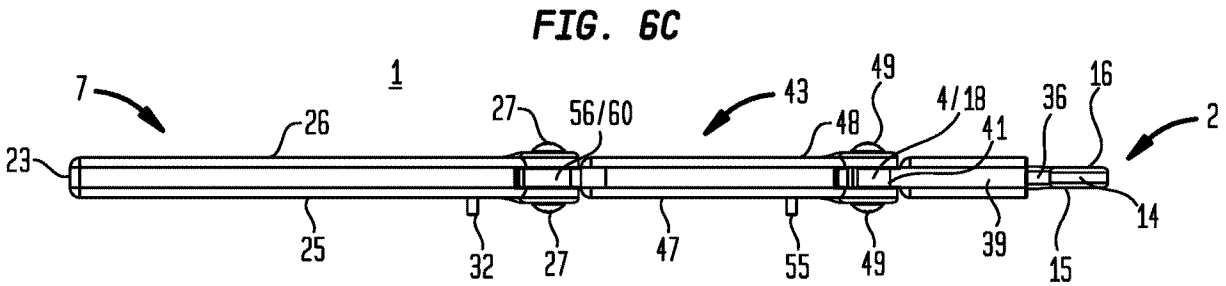
FIG. 6C shows a first side view of the particular embodiment of the wrench assembly shown in FIG. 6A.
Figure 6A:
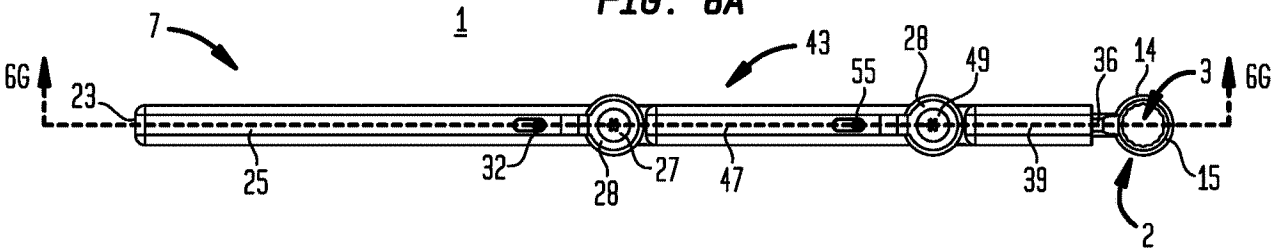
FIG. 6A shows a front view of a particular embodiment of a wrench assembly.
Figure 6E:
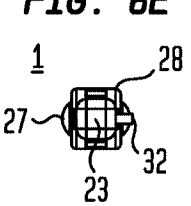
FIG. 6E shows a first end view of the particular embodiment of the wrench assembly shown in FIG. 6A.
Figure 6F:
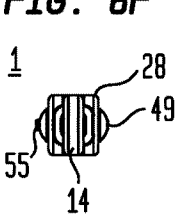
FIG. 6F shows a second end view of the particular embodiment of the wrench assembly shown in FIG. 6A.
Figure 6D:
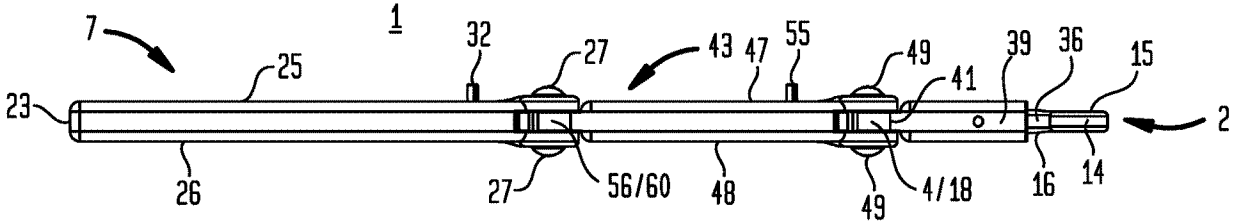
FIG. 6D shows a second side view of the particular embodiment of the wrench assembly shown in FIG. 6A.
Figure 6B:
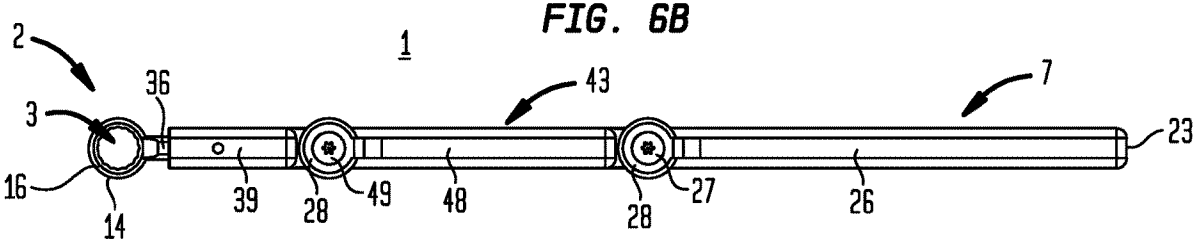
FIG. 6B shows a rear view of the particular embodiment of the wrench assembly shown in FIG. 6A.
Figure 6G:
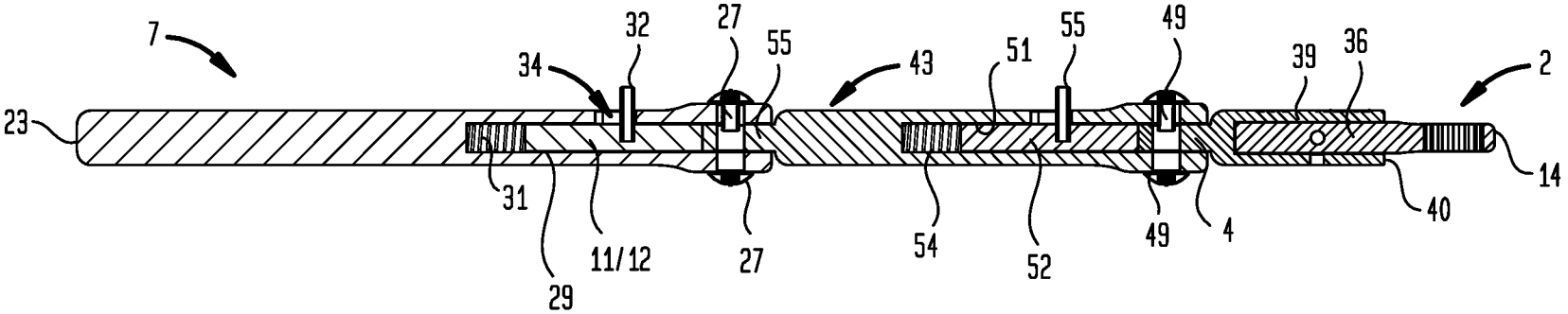
FIG. 6G shows a cross sectional view 6G-6G of the particular embodiment of the wrench assembly shown in FIG. 6A.
Figure 6H:
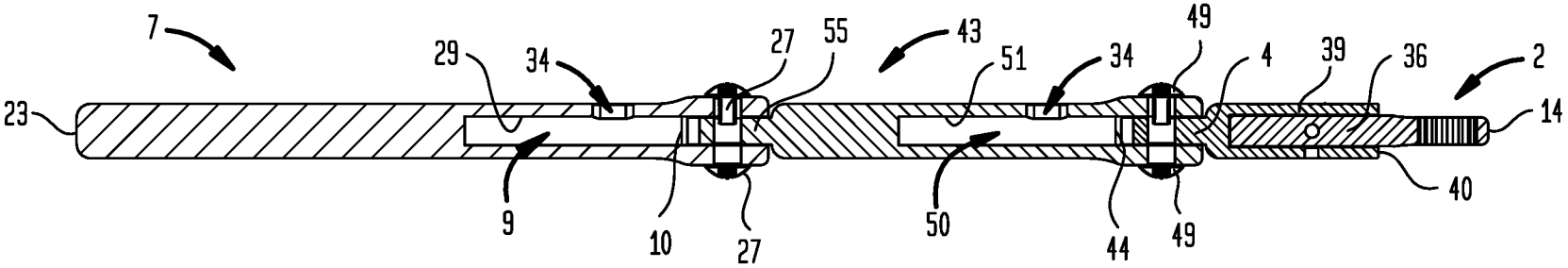
FIG. 6H shows a cross sectional view of the particular embodiment of the wrench assembly shown in FIG. 6A, but whereby the first axial cavity disposed in the handle is shown devoid of a first lock, a first biasing element, and a first actuator, and the third axial cavity disposed in the elongate member is shown devoid of a second lock, a second biasing element, and a second actuator.

Now referring primarily to FIG. 6G and FIG. 6H, the elongate member (43) can include a third axial cavity (50) disposed therein to communicate with the elongate member open first end (44), whereby the third axial cavity (50) can be laterally bound by an elongate member internal surface (51) of the elongate member (43).

Now referring primarily to FIG. 6G and FIG. 7, the wrench assembly (1) can further include a second lock (52) (i) configured for slidable disposition or (ii) slidably disposed within the third axial cavity (50), whereby the second lock (52) may be similar to the first lock (11) described above. When in the first position (12), a second lock end (53) of the second lock (52) can dispose (i) outwardly from the third axial cavity (50) or (ii) toward the elongate member open first end (44). When in the second position (13), the second lock end (53) can dispose (i) inwardly, receding into the third axial cavity (50), or (ii) away from the elongate member open first end (44).

Correspondingly, when the first pivotal member (4) and the elongate member (43) are pivotally coupled, the second lock (52) in the first position (12) disposes the second lock end (53) toward the elongate member open first end (44) for engagement with a radial slot (6) disposed in the first pivotal member (4) to preclude movement of the first pivotal member (4) and the head (2) coupled to the first pivotal member (4) about the first pivot axis (8), which may fix the position of the head (2) in relation to the elongate member (43).

In contrast, when the first pivotal member (4) and the elongate member (43) are pivotally coupled, the second lock (52) in the second position (13) disposes the second lock end (53) away from elongate member open first end (44), thereby disengaging the second lock end (53) from the first pivotal member (4) and in particular, disengaging the second lock end (53) from a radial slot (6) disposed in the first pivotal member (4), thus allowing movement of the first pivotal member (4) and the head (2) coupled to the first pivotal member (4) about the first pivot axis (8) to adjust the position of the head (2) in relation to the elongate member (43).

Again referring primarily to FIG. 6G and FIG. 7, as to particular embodiments, the second lock (52) can be biased toward the first position (12) by a second biasing element (54) which can function to bias the second lock end (53) toward the elongate member open first end (44), whereby the second biasing element (54) may be similar to the first biasing element (31) described above.

As to particular embodiments, the wrench assembly (1) can further include a second actuator (55) coupled to the second lock (52), whereby the second actuator (55) can facilitate sliding of the second lock (52) within the third axial cavity (50), for example between the first position (12) and the second position (13). As to particular embodiments, the second actuator (55) may be similar to the first actuator (32) described above.

As stated above, the elongate member (43) can couple to the handle (7), thus pivotally coupling the head (2) to the handle (7). As to particular embodiments, the elongate member (43) can pivotally couple to the handle (7). Following, a second pivotal member (56) can be coupled to, directly coupled to, connected to, directly connected to, or integrated with the elongate member (43). For example, the second pivotal member (56) can be axially coupled to the elongate member second end (45). The second pivotal member (56) can include a second pivotal member bore (57) disposed therein to communicate between second pivotal member first and second faces (58)(59), and a plurality of radial slots (6) inwardly extending from a second pivotal member side surface (60) toward a central portion of the second pivotal member (56), whereby the second pivotal member (56) may be similar to the first pivotal member (4), as described above.

Following, the first pivot element (27) can pass through aligned handle and second pivotal member bores (24)(57) to pivotally couple the elongate member (43) to the handle (7) for pivotal movement about a second pivot axis (61), whereby the first pivot element (27) can define the second pivot axis (61).

Accordingly, when the second pivotal member (56) and the handle (7) are pivotally coupled, the first lock (11) in the first position (12) can preclude movement of the second pivotal member (56) about the second pivot axis (61), which may fix the position of the elongate member (43) in relation to the handle (7), whereby the first lock (11) can function in a similar fashion as that described above for the first lock (11) in relation to the first pivotal member (4) and the handle (7).

Figure 9A:
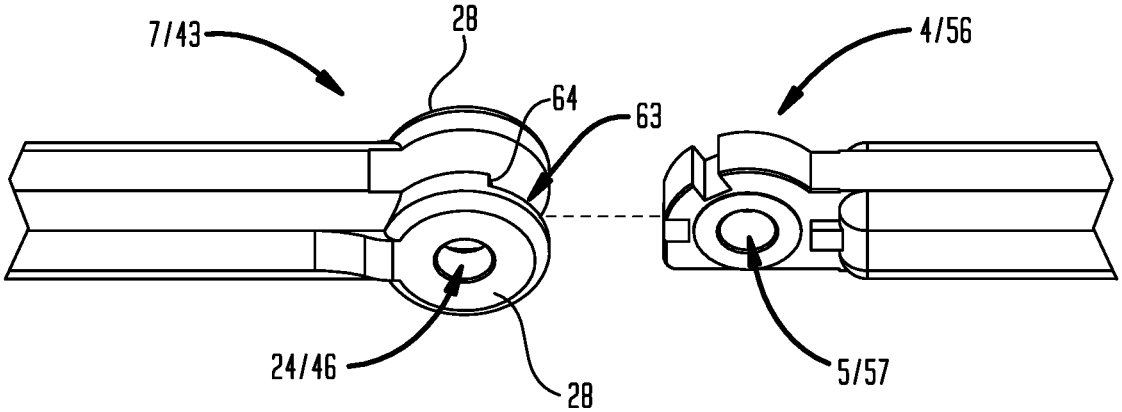
FIG. 9A shows an enlarged perspective view of a particular embodiment of a wrench assembly having a stop assembly.
Figure 9B:
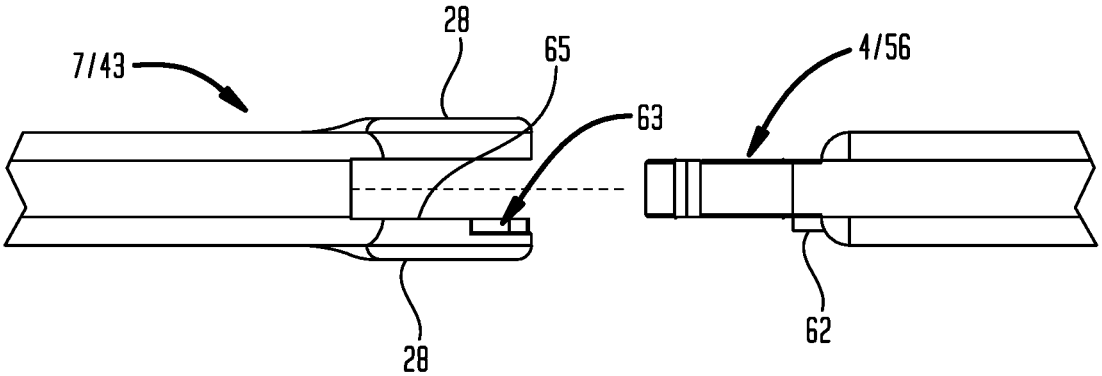
FIG. 9B shows an enlarged side view of the stop assembly shown in FIG. 9A.
Figure 9C:
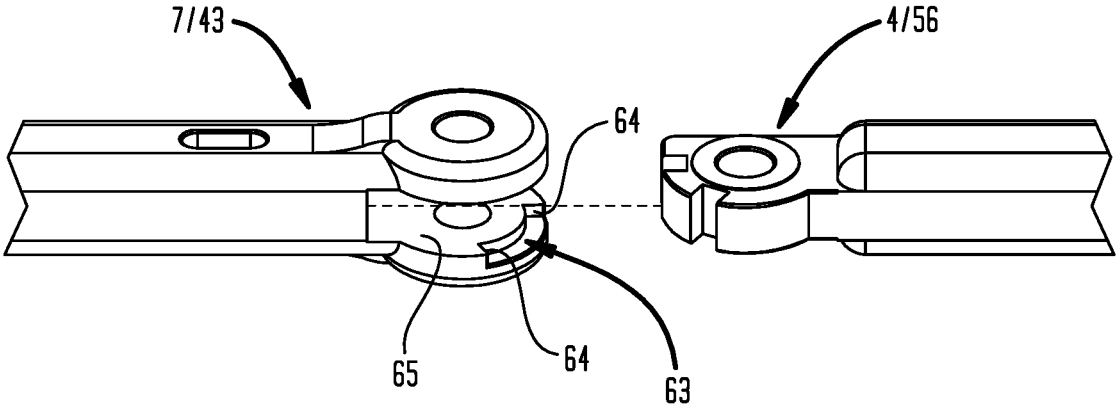
FIG. 9C shows an enlarged perspective view of the stop assembly shown in FIG. 9A.

Now referring primarily to FIG. 9A through FIG. 9C, the wrench assembly (1) can further include a stop assembly configured to limit rotation about a pivot axis (such as the first or second pivot axes (8)(61)) passing through aligned bores of the wrench assembly (1) (such as aligned handle and first pivotal member bores (24)(5), aligned elongate member and first pivotal member bores (46)(5), or aligned handle and second pivotal member bores (24)(57)). The stop assembly can include (i) a stop element (62) and (ii) a circumferential recess (63) terminating in end walls (64). The circumferential recess (63) can provide a travel path for the stop element (62) between the end walls (64), whereby upon travel to one of the end walls (64), the stop element (62) can abuttingly engage with the end wall (64) to stop travel of the stop element (62) in that direction.

As to particular embodiments, the stop element (62) can be coupled to a pivotal member (4)(56), whereby the stop element (62) can be configured as a protrusion which outwardly extends from a pivotal member face (19)(20)(58)(59). As to particular embodiments, the protrusion can radially outwardly extend from the pivotal member bore (5)(57).

As to particular embodiments, the circumferential recess (63) can be disposed about a bore (such as a handle or elongate member bore (24)(46)) which aligns with a pivotal member bore (5)(57), whereby a pivot axis (8)(61) passes through the aligned bores. As to particular embodiments having a bore (24)(46) disposed in a pair of axial protrusions (28), the circumferential recess (63) can be disposed within an axial protrusion (28), for example the bore (24)(46) can inwardly extend into an axial protrusion inner face (65). Following, upon alignment of the bores (24)(46)(5)(57), the protrusion can be received within the circumferential recess (63) and the pivotal member (4)(56) can pivot relative to the handle (7) or elongate member (43) until the protrusion abuttingly engages one of the end walls (64) bounding the circumferential recess (63) to stop pivotal movement of the pivotal member (4)(56) relative to the handle (7) or elongate member (43).

A method of making the wrench assembly (1) detailed above includes providing a first pivotal member (4) coupled to a head (2) having an opening (3) disposed therein, whereby the first pivotal member (4) includes a plurality of radial slots (6) inwardly extending therein; and providing a handle (7) configured to pivotally couple to the head (2).

The method of making the wrench assembly (1) can further include providing additional components of the wrench assembly (1), as described above and in the claims.

Regarding production, the wrench assembly (1) or components of the wrench assembly (1) can be made from any of a numerous and wide variety of processes depending upon the application, such as molding, press molding, injection molding, fabrication, machining, printing, additive printing, or the like, or combinations thereof, as one piece or assembled from a plurality of pieces into an embodiment of the wrench assembly (1).

Further regarding production, the wrench assembly (1) or components of the wrench assembly (1) can be made from any of a numerous and wide variety of materials depending upon the application, such as rigid materials which can include as non-limiting examples: metal, wood, plastic, plastic-like material, or the like, or combinations thereof.

As can be easily understood from the foregoing, the basic concepts of the present invention may be embodied in a variety of ways. The invention involves numerous and varied embodiments of a wrench assembly and methods for making and using such a wrench assembly.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pivot" should be understood to encompass disclosure of the act of "pivoting"—whether explicitly discussed or not—and, conversely, were there effectively disclosure of the act of "pivoting", such a disclosure should be understood to encompass disclosure of a "pivot" and even a "means for pivoting". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the wrench assemblies herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A wrench assembly, comprising:

a head having an opening disposed therein;

an elongate body having opposing elongate body first and second ends, said head integrated with said elongate body first end;

an elongate sleeve having an elongate sleeve open first end opposite an elongate sleeve second end, said elongate sleeve comprising a first axial cavity which communicates with said elongate sleeve open first end;

wherein said elongate body is receivable within said first axial cavity;

a first pivotal member integrated with said elongate sleeve second end, said first pivotal member comprising a first pivotal member side surface disposed between opposing first pivotal member first and second faces;

a first plurality of radial slots inwardly extending into said first pivotal member in radially spaced-apart relation, each said slot inwardly extending from said first pivotal member side surface toward a first pivotal member central portion, each said slot extending from said first pivotal member first face to said first pivotal member second face;

an elongate member having an elongate member open first end opposite an elongate member second end;

wherein said first pivotal member pivotally couples to said elongate member open first end;

said elongate member comprising a second axial cavity which communicates with said elongate member open first end;

a first lock axially disposed within said second axial cavity to slide therein by a first actuator partially extending into said first lock, said first actuator configured to facilitate sliding of said first lock within said first axial cavity, said first lock configured to releasably fix the position of said head in relation to said elongate member by selectively engaging one of said first plurality of radial slots;

a second pivotal member integrated with said elongate member second end, said second pivotal member comprising a second pivotal member side surface disposed between opposing second pivotal member first and second faces;

a second plurality of radial slots inwardly extending into said second pivotal member in radially spaced-apart relation, each said slot inwardly extending from said second pivotal member side surface toward a second pivotal member central portion, each said slot extending from said second pivotal member first face to said second pivotal member second face;

a handle having a handle open first end opposite a handle second end;

wherein said second pivotal member pivotally couples to said handle open first end;

said handle comprising a third axial cavity which communicates with said handle open first end; and a second lock axially disposed within said third axial cavity to slide therein by a second actuator partially extending into said second lock, said second actuator configured to facilitate sliding of said first lock within said first axial cavity, said second lock configured to releasably fix the position of said elongate member in relation to said handle by selectively engaging one of said second plurality of radial slots;

wherein said first pivotal member pivotally couples said head to said elongate member and said second pivotal member pivotally couples said elongate member to said handle.

2. The wrench assembly of claim 1, wherein said first pivotal member pivotally couples said elongate sleeve to said elongate member to pivot about a first pivot axis passing through a first pivotal member bore disposed within said first pivotal member, and said second pivotal member pivotally couples said elongate member to said handle to pivot about a second pivot axis passing through a second pivotal member bore disposed within said second pivotal member.

3. The wrench assembly of claim 2, further comprising an elongate member bore disposed within said elongate member to communicate between elongate member first and second faces, and a handle bore disposed within said handle to communicate between handle first and second faces.

4. The wrench assembly of claim 3, further comprising a first pivot element configured to pass through aligned elongate member bore and said first pivotal member bore and a second pivot element configured to pass through aligned said handle bore and said second pivotal member bore.

5. The wrench assembly of claim 4, wherein each of said elongate member bore and said handle bore is disposed in a respective pair of axial protrusions disposed in spaced-apart relation.

6. The wrench assembly of claim 1, further comprising a first biasing element which biases said first lock to engage with said one of said first plurality of radial slots.

7. The wrench assembly of claim 6, said first biasing element comprising a resiliently compressible element disposed within said first axial cavity.

8. The wrench assembly of claim 1, wherein said first actuator passes through a longitudinal channel disposed within said elongate member to communicate between said second axial cavity and an elongate member external surface.

9. The wrench assembly of claim 1, said opening of said head is laterally enclosed.

10. The wrench assembly of claim 9, wherein said head is configured as an annular member.

11. The wrench assembly of claim 10, said head is configured as a box-end wrench.

12. The wrench assembly of claim 1, said head configured as an open-end wrench.

* * * * *